US006186036B1

(12) United States Patent
Huang

(10) Patent No.: US 6,186,036 B1
(45) Date of Patent: Feb. 13, 2001

(54) TOOL COMBINATION

(76) Inventor: Yung Hsu Huang, No. 10, Lane 38, Li Der Street, Taiping City, Taichung Hsien (TW)

( * ) Notice: Under 35 U.S.C. 154(b), the term of this patent shall be extended for 0 days.

(21) Appl. No.: 09/376,409

(22) Filed: Aug. 18, 1999

(51) Int. Cl.[7] ..... B25B 23/16
(52) U.S. Cl. ..... 81/490; 81/177.4
(58) Field of Search ..... 81/177.1, 177.4, 81/438, 439, 489, 490

(56) References Cited

U.S. PATENT DOCUMENTS 5,179,748 * 1/1993 Lipic ..... 81/439 X
5,613,413 * 3/1997 Huang ..... 81/438 X
5,704,260 1/1998 Huang ..... 81/177.4
5,740,706 * 4/1998 Tseng ..... 81/490

FOREIGN PATENT DOCUMENTS

0312775 * 4/1989 (EP) ..... 81/490

* cited by examiner

*Primary Examiner*—David A. Scherbel
*Assistant Examiner*—Anthony Ojini
(74) *Attorney, Agent, or Firm*—Charles E. Baxley

(57) ABSTRACT

A tool includes a housing having a middle partition for forming two separated chambers. The housing includes a number of hubs extended inward of each of the chambers for receiving two times of the tool members. Two caps are detachably secured to the ends of the housing and each has an engaging hole for receiving and for driving the tool members. The housing includes a tubular member formed through the partition for receiving a driving stem. The caps includes a number of ribs and a stop for retaining the tool members and the driving stem in the housing.

5 Claims, 4 Drawing Sheets

TOOL COMBINATION

BACKGROUND OF THE INVENTION

1. Field of the Invention

The present invention relates to a tool, and more particularly to a tool combination for receiving a number of tool members.

2. Description of the Prior Art

The applicant has developed various kinds of screw driver handles having a space for receiving the tool members. One of the typical tools is disclosed in U.S. Pat. No. 5,704,260 to Huang and comprises only one chamber for receiving the tool members. The number of the tool members that may be received in the tool handle is limited.

The present invention has arisen to mitigate and/or obviate the afore-described disadvantages of the conventional tools.

SUMMARY OF THE INVENTION

The primary objective of the present invention is to provide a tool combination including a structure for receiving a number of tool members.

In accordance with one aspect of the invention, there is provided a tool combination comprising a housing including an interior having a partition provided therein and provided in a middle portion thereof for separating the interior of the housing into two separated chambers, the housing including a plurality of hubs extended from the partition and extended inward of each of the chambers thereof, the housing including two ends, a plurality of tool members received in the hubs of the housing, and two caps detachably secured to the ends of the housing respectively. At least one of the caps includes an engaging hole formed therein for receiving the tool members and for driving the tool members.

The housing includes a tubular member formed therein and extended through the partition of the housing, and a driving stem received in the tubular member of the housing. The housing includes at least one engaging hole formed therein for receiving the tool members and for driving the tool members.

The ends of the housing each includes a shoulder formed therein, the caps each includes a peripheral flange extended therefrom and engaged into the chambers of the housing respectively and engaged with the shoulders of the housing respectively for securing the caps to the housing. The caps each includes a plurality of ribs extended therefrom for engaging with the tool members and for retaining the tool members in the housing when the caps are secured onto the housing. The caps each includes a stop extended therefrom for engaging with the driving stem and for retaining the driving stem in the housing when the caps are secured onto the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
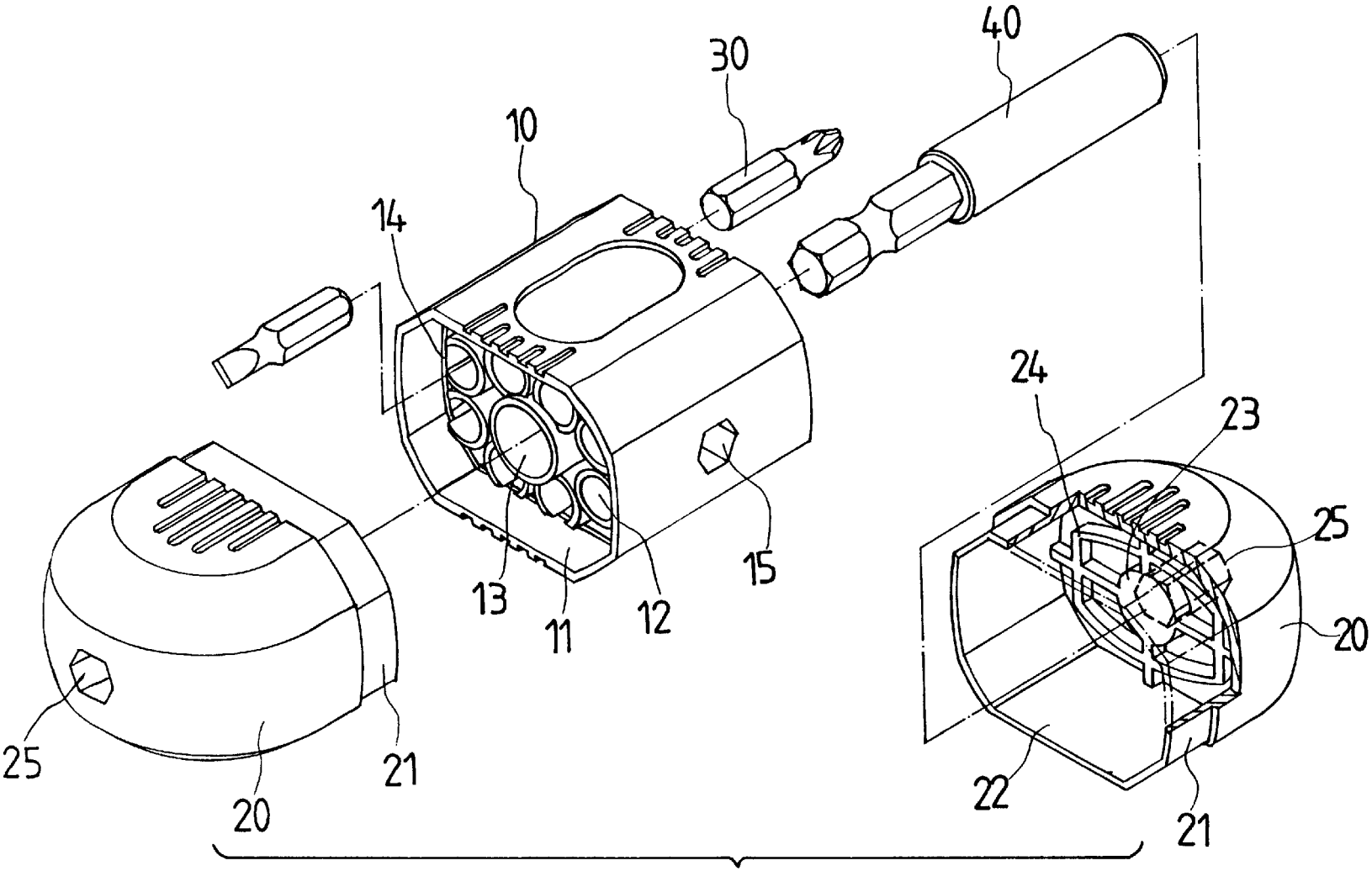
FIG. 1 is an exploded view of a tool combination in accordance with the present invention.
Figure 2:
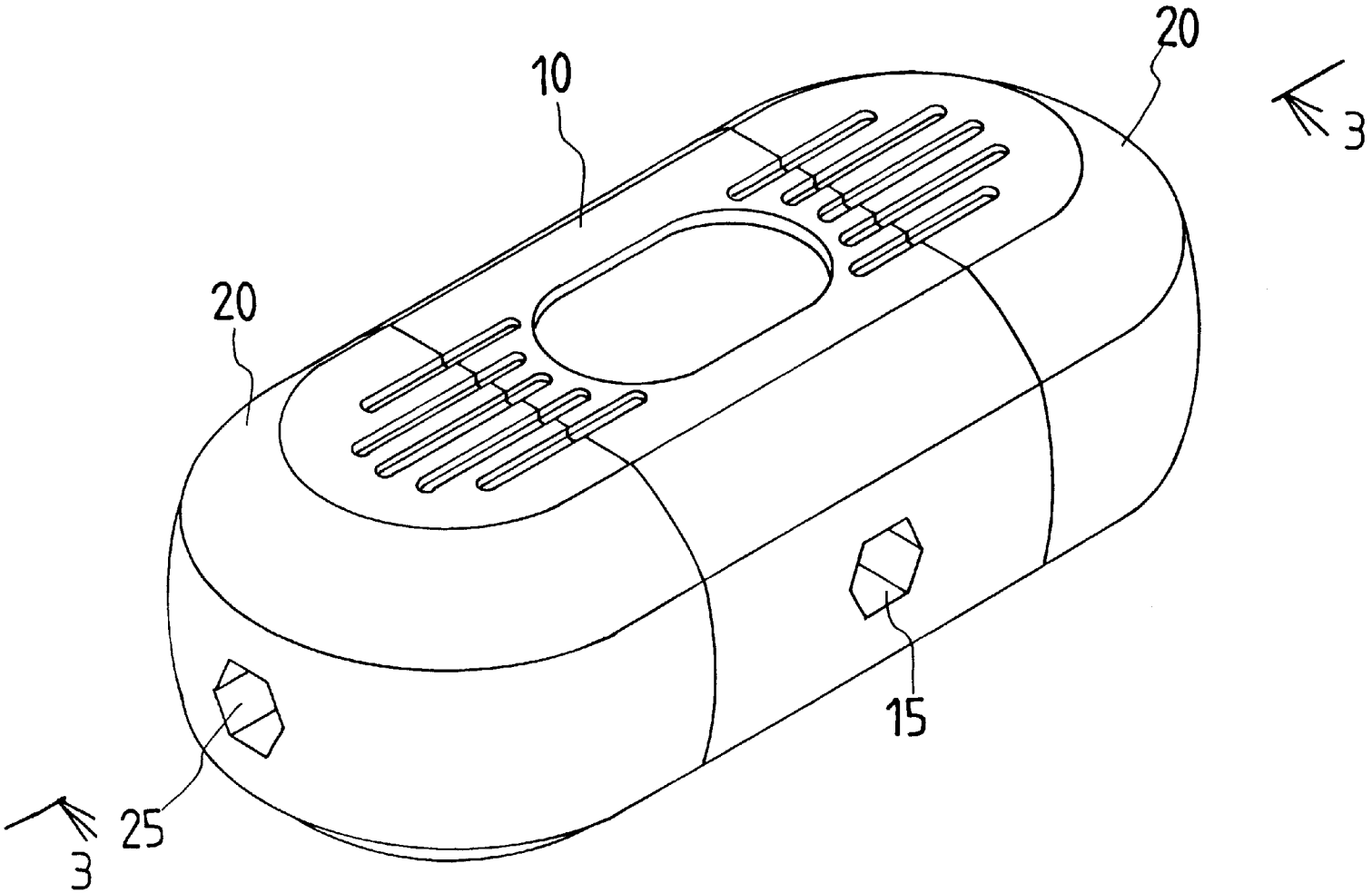
FIG. 2 is a perspective view of the tool combination.
Figure 3:
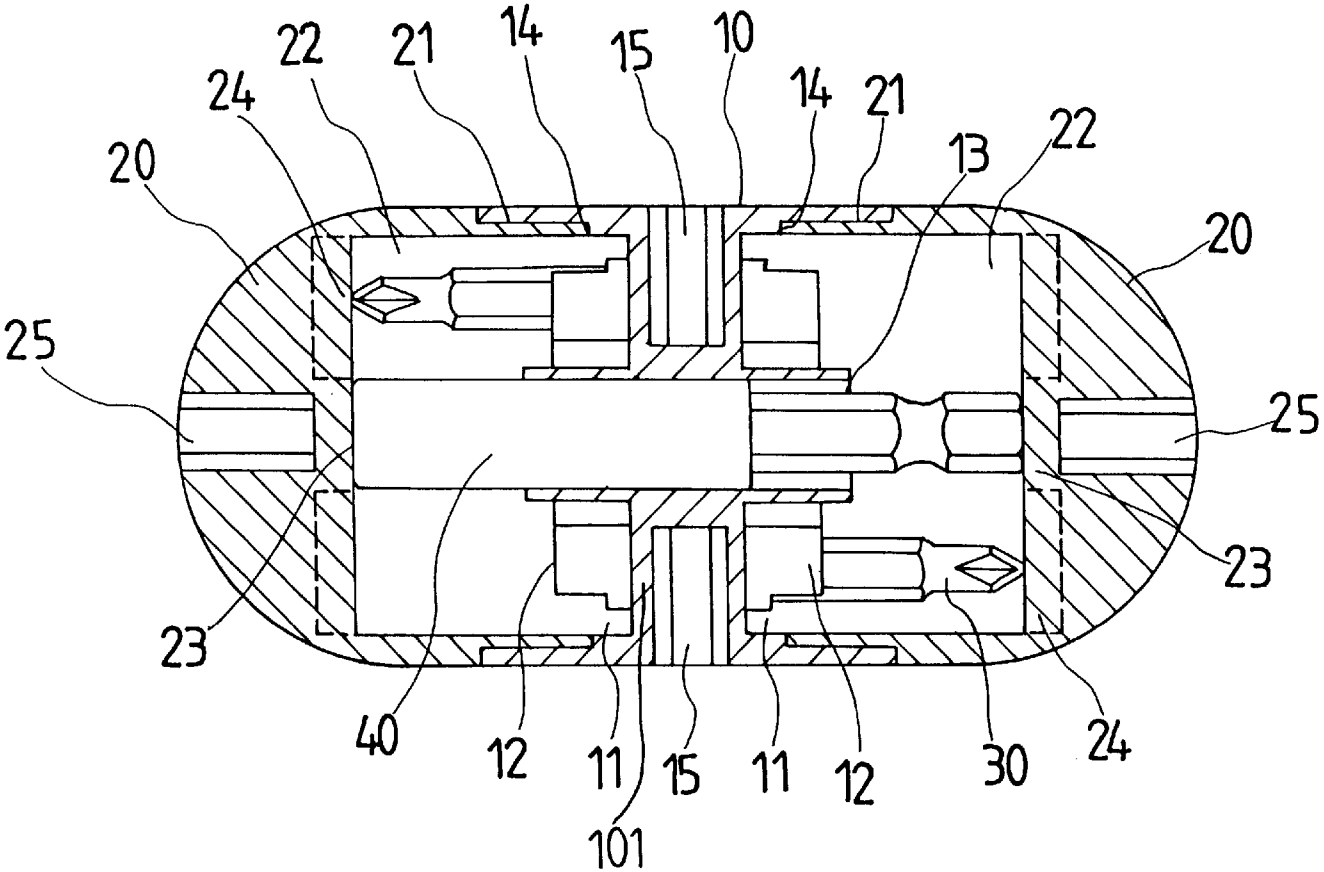
FIG. 3 is a cross sectional view taken along lines 3—3 of FIG. 2.
Figure 5:
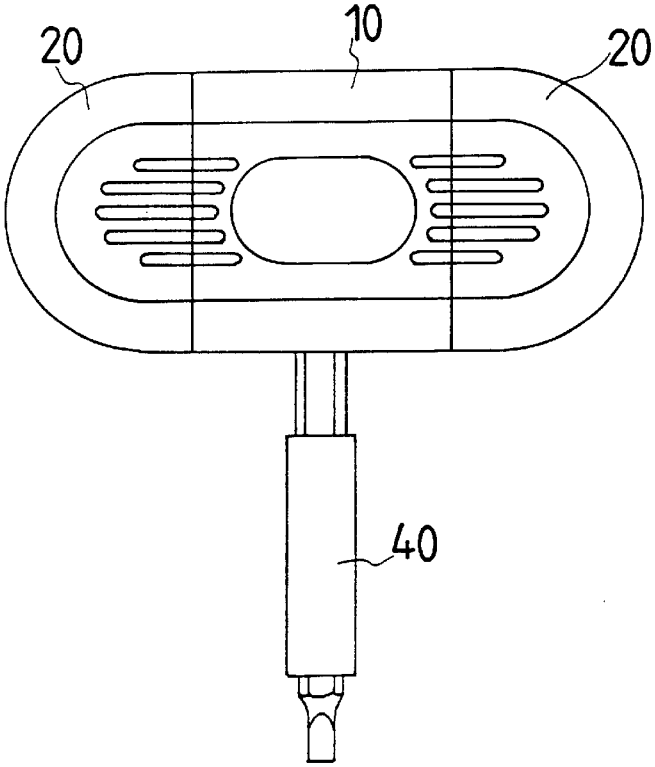
FIGS. 4 and 5 are plane views illustrating the operation of the tool combination.

Referring to the drawings, and initially to FIGS. 1–3, a tool combination in accordance with the present invention comprises a housing 10 including a non-circular cross section and including a partition 101 (FIG. 3) formed in the middle portion thereof for separating the interior of the housing 10 into two separated chambers 11. The housing 10 includes two ends each having a peripheral shoulder 14 formed therein, and includes a number of hubs 12 extended inward of each of the chambers 11 thereof for receiving tool members 30. It is to be noted that the housing 10 includes two chambers 11 for receiving two times of the hubs 12 and thus for receiving two times of the tool members 30 such that the number of the tool members 30 may be increased to double of that of the conventional tools. The housing 10 includes a tubular member 13 formed therein and formed through the partition 101 thereof for receiving and storing a driving stem 40. The housing 10 includes one or more engaging holes 15 formed in the outer peripheral portion thereof and particularly formed in the middle portion thereof and formed in the partition 101 thereof for receiving the tool members 30 directly or indirectly via the driving stem 40 (FIG. 5).

Figure 4:
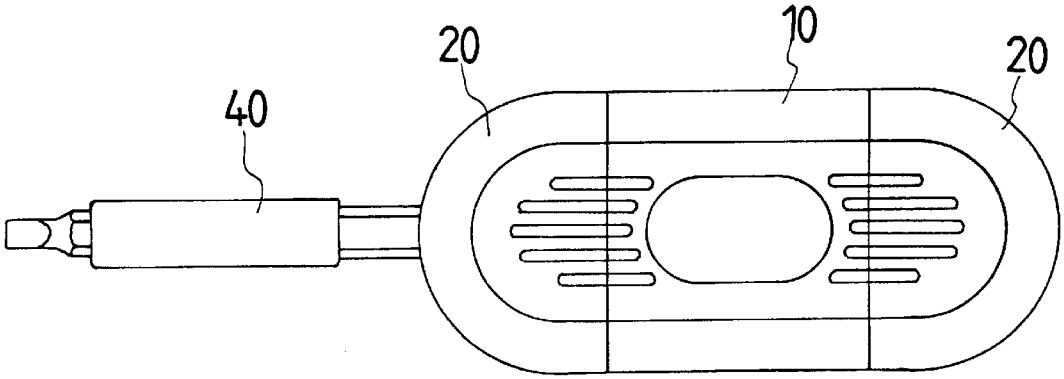

Two caps 20 each includes a peripheral flange 21 extended from one end thereof and engaged into the respective chambers 11 of the housing 10 for force-fitting onto the housing 10 and for allowing the caps 20 to be detachable from the housing 10. The shoulders 14 of the housing 10 and the peripheral flanges 21 of the caps 20 may limit the relative engagement of the caps 20 onto the housing 10. The caps 20 each includes a space 22 formed therein for receiving a portion of the tool members 30 and/or of the driving stem 40 (FIG. 3), and each includes one or more engaging holes 25 formed therein for receiving the tool members 30 directly or indirectly via the driving stem 40 (FIG. 4). The caps 20 each includes a stop 23 and one or more ribs 24 or a spider rib (24) formed therein and extended inward of the spaces 22 thereof for engaging with the driving stem 40 and the tool members 30 and for stably retaining the driving stem 40 and the tool members 30 in place (FIG. 3). The caps 20 each also includes a non-circular cross section corresponding to that of the housing 10 for allowing the caps 20 to be rotated in concert with the housing 10 and for preventing the caps 20 from rotating relative to the housing 10.

Accordingly, the tool combination in accordance with the present invention includes two chambers 11 formed therein and separated by a partition 101 for receiving two times of the hubs 12 and/or the tool members 30. The increasing number of the tool members allows the user to carry the sufficient and enough tool members with only one single tool combination.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool combination comprising:

a housing including an interior having a partition provided therein and provided in a middle portion thereof for separating said interior of said housing into two separated chambers, said housing including a plurality of hubs extended from said partition and extended inward of each of said chambers thereof, said housing including two ends, a plurality of tool members received in said hubs of said housing, and two caps detachably secured to said ends of said housing respectively, at least one of said caps including an engaging hole formed therein for receiving the tool members and for driving the tool members, said caps each including a plurality of ribs extended thereof for engaging with said tool members and for retaining said tool members in said housing when said caps are secured onto said housing.

2. The tool combination according to claim 1, wherein said housing includes a tubular member formed therein and extended through said partition of said housing, and a driving stem received in said tubular member of said housing.

3. The tool combination according to claim 1, wherein said housing includes at least one engaging hole formed therein for receiving the tool members and for driving the tool members.

4. The tool combination according to claim 1, wherein said ends of said housing each includes a shoulder formed therein, said caps each includes a peripheral flange extended therefrom and engaged into said chambers of said housing respectively and engaged with said shoulders of said housing respectively for securing said caps to said housing.

5. A tool combination comprising:

a housing including an interior having a partition provided therein and provided in a middle portion thereof for separating said interior of said housing into two separated chambers, said housing including a plurality of hubs extended from said partition and extended inward of each of said chambers thereof, said housing including two ends and including a tubular member formed therein and extended through said partitions of said housing, a driving stem received in said tubular member of said housing, a plurality of tool members received in said hubs of said housing, and two caps detachably secured to said ends of said housing respectively, at least one of said caps including an engaging hole formed therein for receiving the tool members and for driving the tool members, said caps each including a stop extended thereof for engaging with said driving stem and for retaining said driving stem in said housing when said caps are secured onto said housing.

* * * * *